US005849420A

United States Patent [19]

Nishikawa et al.

[11] Patent Number: 5,849,420

[45] Date of Patent: Dec. 15, 1998

[54] PUNCHED ELECTRON GUN PART OF A FE-CR-NI ALLOY

[75] Inventors: Kiyoaki Nishikawa; Yoshihiro Ozeki; Masazumi Mori, all of Kanagawa, Japan

[73] Assignee: Nippon Mining & Metals Co., Ltd., Tokyo, Japan

[21] Appl. No.: 579,010

[22] Filed: Dec. 27, 1995

[30] Foreign Application Priority Data

Dec. 27, 1994 [JP] Japan ..... 6-336866

[51] Int. Cl.[6] ..... C22C 38/40; C22C 38/58

[52] U.S. Cl. ..... 428/596; 420/43; 420/44

[58] Field of Search ..... 428/596, 577; 420/43, 44

[56] References Cited

U.S. PATENT DOCUMENTS

| | | | |
|---|---|---|---|
| 4,162,930 | 7/1979 | Abe et al. | 420/43 |
| 4,530,720 | 7/1985 | Moroishi et al. | 420/43 |
| 4,836,976 | 6/1989 | Jacobs | 420/43 |
| 5,081,393 | 1/1992 | Kinami | 420/43 |
| 5,203,932 | 4/1993 | Kato et al. | 420/43 |
| 5,569,334 | 10/1996 | Kawata et al. | 420/44 |

FOREIGN PATENT DOCUMENTS

| | | | |
|---|---|---|---|
| 58-71360 | 4/1983 | Japan | 420/43 |

*Primary Examiner*—John J. Zimmerman
*Attorney, Agent, or Firm*—Kubovcik & Kubovcik

[57] ABSTRACT

A punched part consists of an Fe—Cr—Ni alloy essentially consisting of from 15 to 20% of Cr, from 9 to 15% of Ni, from 0.001 to 0.0050% of S, the balance being Fe and unavoidable impurities. The burrs formed during punching are suppressed due to addition of S to the Fe—Cr—Ni alloy.

15 Claims, 4 Drawing Sheets

PUNCHED ELECTRON GUN PART OF A FE-CR-NI ALLOY

BACKGROUND OF INVENTION

1. Field of Invention

The present invention relates to an Fe—Cr—Ni alloy, which is a non-magnetic stainless steel used for a part of an electron gun. More particularly, the present invention relates to an Fe—Cr—Ni alloy having improved punchability and to the punched part of an electron gun.

2. Description of Related Arts

The electron gun is a component of the shadow-mask type color Braun tube.

FIG. 1 is a cross-sectional drawing of the shadow-mask type color Braun tube.

FIGS. 2A and 2B show shows an elevational view and a cross-sectional view of the punched part of an electron gun.

Referring to FIG. 1, a fluorescent coating 2, which emits light of the primary colors, i.e., red, green and blue, is applied on panel 1. An electron beam 3 is emitted from the electron gun 4 provided in the neck portion, and is deflected and scanned by deflecting yoke 5. An shadow mask is denoted by 6. A magnetic shield is denoted by 7. These parts 1–7 are all known.

In FIGS. 2A and 2B, the punched part is denoted by 10. The electron beams for light emitting red, green and blue pass through the apertures 10*a*, 10*b*, and 10*c* of the punched part 10, respectively. The minute apertures 10*a–c* can be formed by coining and punching of a sheet.

Generally, the punched part 10 of an electron gun used for a receiver is completed by subjecting an Fe—Cr—Ni based alloy, which is a 0.05 to 0.5 mm thick non-magnetic stainless-steel sheet to forming as described above. However, since this alloy has a high toughness, burrs are likely to be formed on the tip edge 10*e* (FIG. 2) around the apertures 10*a–c*, when punched. The burrs exert detrimental influence upon the performance of the punched part 10 of the electron gun, which is required to have stable quality, high accuracy, durability at high temperature and high voltage. Even minute burrs become critically detrimental defects, for example, such that abnormal discharge occurs when high voltage is applied thereto. As a result, the voltage-withstanding performance of an electron gun is detrimentally lowered.

According to a recent trend in manufacture of the Braun tube, its screen is enlarged, and its quality is enhanced. Along with such trend, the diameter of apertures, which are formed by press punching at manufacture of the punched part 10 of an electron gun, must be refined to be as small as or less than the sheet thickness. Minute burrs, which do not incur any problem conventionally, have come to cause a serious problem recently. It is therefore imperative that the burrs, which are incidentally formed on the punched part 10 of the electron gun, be as small as possible.

The present inventors tried to prevent even minute burrs, when the apertures for passage of electron beams are formed on the stainless steel sheet by punching. In these trials, the punching conditions were varied, and the mechanical properties, particularly toughness of the sheets, were also varied. The burrs were, however, inevitably formed as is described with reference to FIG. 2. Although the burrs could be of minute size, they were larger than the required level which is becoming more and more strict at present.

SUMMARY OF THE INVENTION

It is, therefore, an object of the present invention to provide an Fe—Cr—Ni based alloy having improved punchability, used for a punched part of an electron gun.

It is also an object of the present invention to provide a press-punched part of an electron gun, whose burrs are suppressed.

In accordance with the object of the present invention, there is provided an Fe—Cr—Ni alloy used for a punched part of an electron gun, which consists essentially of from 15 to 20% of Cr, from 9 to 15% of Ni, from 0.0010 to 0.0050% of S, preferably from 0.0010 to 0.0030% of S, the balance being Fe and unavoidable impurities.

The above-mentioned alloy is usually in the form of a sheet, whose thickness is from approximately 0.05 to 0.6 mm. The hardness of the above-mentioned alloy is usually from approximately Hv 120 to 160.

In accordance with another object of the present invention, there is also provided a punched part of an electron gun, which consists of an Fe—Cr—Ni alloy which consists essentially of from 15 to 20% of Cr, from 9 to 15% of Ni, from 0.0010 to 0.0050% of S, preferably from 0.0010 to 0.0030% of S, the balance being Fe and unavoidable impurities.

The punched part according to an embodiment of the present invention, comprises one or more apertures formed by punching.

In the punched part according to another embodiment, an aperture(s) has a diameter approximately the same as or less than the sheet thickness.

In the punched part according to a further embodiment of the present invention, an aperture(s) is defined by a portion of the sheet, from which a slug is separated by punching, and, further, burrs formed on said portion of the sheet have a thickness of less than 20 $\mu$m and a height of less than 10 $\mu$m.

BRIEF DESCRIPTION OF DRAWINGS

FIG. 4(*b*) is a photogragh similar to FIG. 4(*b*) with regard to the comparative alloy No. 5.

DESCRIPTION OF THE PREFERRED EMBODIMENTS

Figure 1:
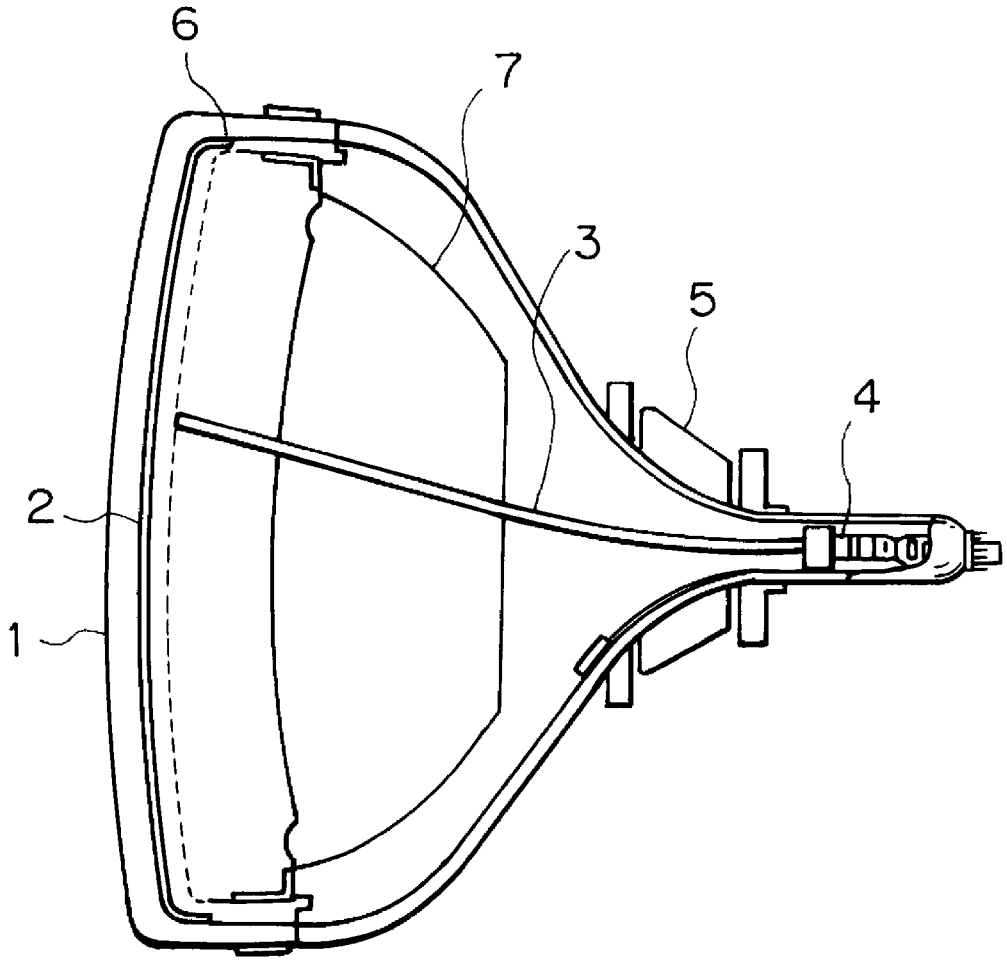
Fig. 1 PRIOR ART
FIG. 1 is a cross sectional drawing of the shadow-mask type color Braun tube.
Figure 2A:
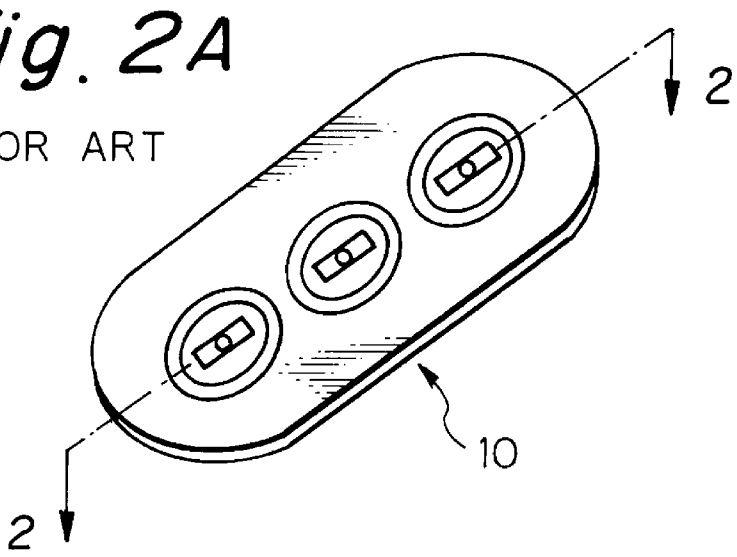
Fig. 2A PRIOR ART
FIG. 2 shows an elevational view and a cross sectional view of the punched part of an electron gun.
Figure 2B:
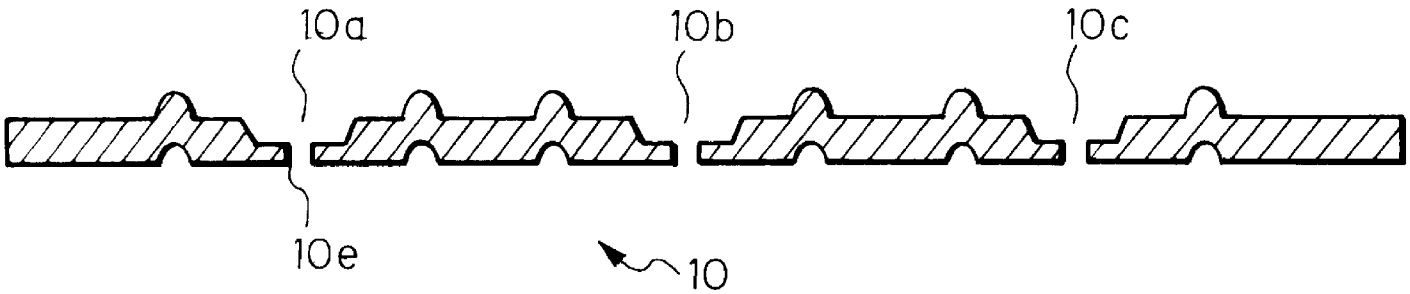
Fig. 2B PRIOR ART

The above mentioned punched part has usually the shape such as shown in FIG. 2 and is provided on the primary surface with minute apertures approximately 0.1 to 0.5 mm in diameter. These minute apertures are formed by press punching via coining or without coining.

The present inventors discovered that the press punching formability can be outstandingly improved by means of specifying the content of S contained in an Fe—Cr—Ni alloy to be in a range of from 0.0010 to 0.0050%, preferably from 0.0010 to 0.0030%, without impairing the hot workability and corrosion resistance. The burrs can, therefore, be suppressed when the Fe—Cr—Ni alloy is punched by pressing to form minute apertures from 0.1 to 0.5 mm in diameter. The above discovery is contradictory to the conventional recognition that sulfur exerts detrimental influence on the hot workability and corrosion resistance.

The composition of the Fe—Cr—Ni alloy according to the present invention is hereinafter described more in detail.

Cr: The punched part of an electron gun must be non-magnetic. The non magnetic property required for this part is 1.005 or less of permeability. In order to impart non-magnetic property to the Fe-based alloy and also to control the permeability, the Cr content should be in a range of from 15 to 20%, preferably from 16 to 18%.

Ni: When the Ni content is less than 9%, the permeability becomes too high. When the Ni content is less than 9% or more than 15%, the workability of an Fe—Cr—Ni alloy into a sheet is impaired. Also when the Ni content is more than 15%, cost increases. The Ni content should, therefore, be in a range of from 9 to 15%, preferably from 11 to 14%.

S: Sulfur is effective to suppress the generation of burrs, when its content is 0.0010% or more. However, sulfur impairs the corrosion resistance and hot workability required to work the material into a sheet when the sulfur content is more than 0.0050%. The sulfur content is, therefore, from 0.0010% to 0.0050%. A more preferred sulfur content is from 0.0010 to 0.0030%. This limitation is based on the concept that S added to the alloy in an appropriate amount forms a sulfur compound, which is believed to be MnS. The particles of such compound distribute uniformly along the grain boundaries and in the crystal grains, with the result that the alloy is rendered appropriately brittle.

Figure 3:
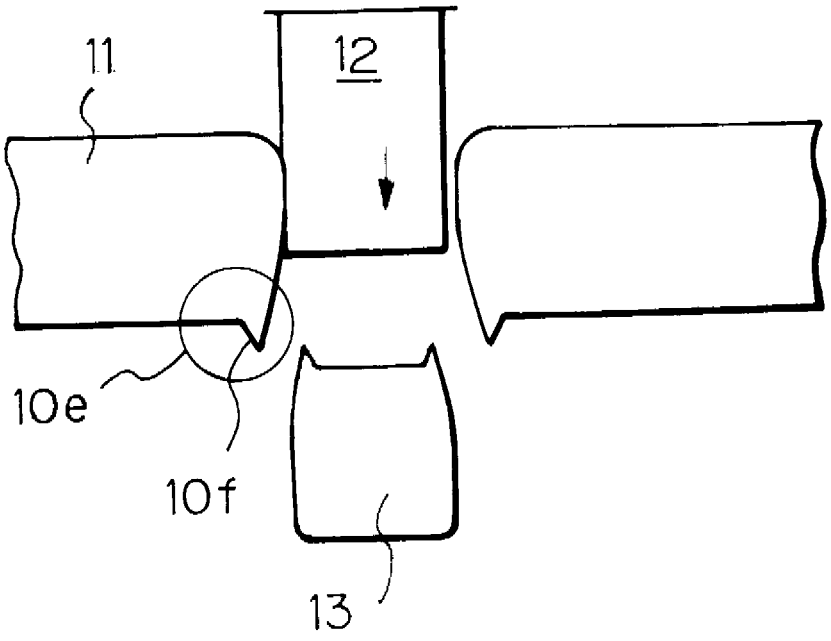
FIG. 3 is a drawing illustrating the press punching method.

Referring to FIG. 3, a sheet 11 is punched by a punch 12. A slug 13 is generated. At the tip end of the sheet 11, where the slug 13 is separated, a burr 10*f* may be formed. The S compounds in the sheet 11 and appropriate brittleness of the sheet 11 contribute to suppress formation of the burr 10*f*.

The components other than the above described Cr, Ni, S and Fe are impurities or incidental elements. Among them carbon (C), within a broad range of from 0.01 to 0.05%, exerts virtually no influence on the formability punchability, corrosion resistance and magnetic properties. Mn, which is a component of the ususal Fe-based alloy, may be present in the Fe—Cr—Ni alloy in such an amount that it is effective to form MnS. The Mn content is not critical but is preferably from 0.005 to 2.5%. Since the other elements such as P, Cu, Si and the like are detrimental to or do not improve the above described properties, their content should be as small as possible.

The iron source to be used as a starting material to produce the Fe—Cr—Ni alloy contains S as an impurity. The possibility that S is contained in the other starting materials, e.g., metallic Ni and metallic Cr, is very low. The preferable iron source is, therefore, one which is subjected to appropriate desulfurizing treatment, for example, desulfurizing of molten pig iron in a ladle, so as to attain the S content within the range described above. When the iron source is of high purity, for example, an electrolytic iron, and is free of S, S is added to the melt of Fe—Cr—Ni alloy so as to attain the S content mentioned above.

The Fe—Cr—Ni alloy for the part of an electron gun is produced for example by the following process.

The alloy, which fulfills the above described composition, is melted, cast and hot- or cold-rolled. Subsequently, the cold rolling and annealing are repeated to finish the alloy in a predetermined thickness.

The so-produced sheet is finished to a part of an electron gun by means of, for example, punching. A press machine can be used for the punching.

The present invention is hereinafter described by way of examples.

EXAMPLE

Alloys having the composition given in Table 1 were melted, cast into ingots, and then hot rolled at 1150°–1260° C. to obtain 4 mm thick slabs. Three-stage cold rolling and annealing at 1050° to 1150° C. were repeated to obtain 0.4 mm thick annealed materials. Alloy Nos. 1 through 4 are inventive, while Alloy Nos. 5 and 6 are comparative. The crystal grains of all alloys were adjusted to No. 9.0. The C content and P content of the ingots were from 0.03 to 0.04% and from 0.015 to 0.02%, respectively.

TABLE 1

| | | Chemcial Composition (weight %) | | | Burrs | | Ratio of ruptured plane |
|---|---|---|---|---|---|---|---|
| Alloy | No. | Cr | Ni | S | largest thickness (μm) | largest height (μm) | (%) |
| Inventive | 1 | 18.5 | 14.5 | 0.0015 | 12 | 5 | 22.3 |
| | 2 | 16.3 | 13.9 | 0.0018 | 17 | 4 | 24.6 |
| | 3 | 16.7 | 14.2 | 0.0025 | 10 | 6 | 26.9 |
| | 4 | 15.4 | 14.5 | 0.0038 | 14 | 5 | 29.2 |
| Comparative | 5 | 16.0 | 14.2 | 0.0003 | 52 | 15 | 12.5 |
| | 6 | 16.5 | 13.8 | 0.0005 | 48 | 12 | 13.2 |

The punchability of the above materials was tested by a press machine with a maximum load of 30 tons. Ten apertures with a diameter of 0.4 mm were formed through each sheet. The largest width and height of the burrs formed by punching were measured. The thickness of burrs is the distance between the protruding end thereof and the outer periphery of an aperture. In addition, the length of the ruptured plane was measured and divided by the sheet thickness. This value is given in percentage in Table 1 as the ratio of the ruptured plane.

Figure 4A:
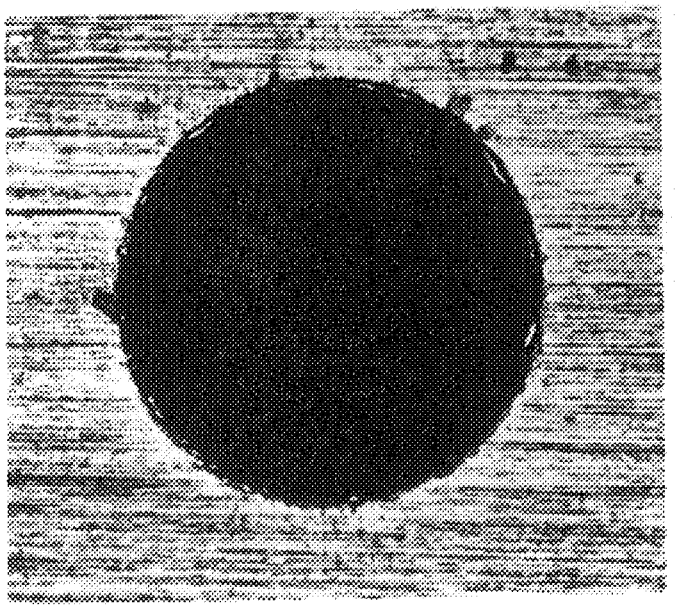
FIG. 4(*a*) is a photograph of the circumferetial portion of an aperture formed by press punching an example of the inventive alloy No. 1, observed from the side where the burrs are formed.
Figure 4B:
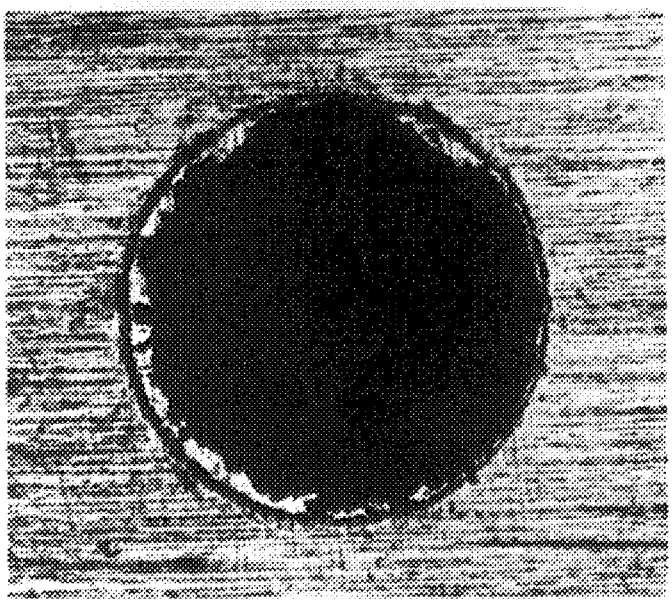

As is clear from Table 1 and FIG. 4, each of the inventive alloys Nos. 1 through 4 exhibits the width and height of burrs smaller than those of the comparative alloys. This indicates that the burrs are suppressed according to the present invention. In addition, each of the inventive alloy Nos. 1 through 4 has a higher ratio of ruptured surface, which indicates that the punchability is improved by the present invention.

We claim:

1. A punched part which consists of an Fe—Cr—Ni alloy consisting of from 15 to 20% of Cr, from 9 to 15% of Ni, from 0.0010 to 0.0050% of S, from 0.01 to 0.05% of C, and Mn in an effective amount to form MnS, the balance being Fe and unavoidable impurities, said punched part being a part of an electron gun.

2. A punched part according to claim 1, having a sheet thickness of from 0.05 to 0.6 mm.

3. A punched part according to claim 1, comprising one or more apertures formed by punching.

4. A punched part according to claim 3, wherein said one or more apertures have a diameter approximately the same as or less than the sheet thickness.

5. A punched part according to claim 4, wherein said one or more apertures are defined by a portion of the sheet, from which a slug is separated by punching, and, further, burrs formed on said portion of the sheet have a thickness of less than 20 μm and a height of less than 10 μm.

6. A punched part according to claim 1, wherein the S content is from 0.0010 to 0.0030%.

7. A punched part according to claim 1, wherein the Mn content is from 0.005 to 2.5%.

8. A punched part according to claim 1, having a hardness of from approximately Hv 120 to 160.

9. A punched part which consists of an Fe—Cr—Ni alloy consisting of from 15 to 20% of Cr, from 9 to 15% of Ni and from 0.0010 to 0.0050% of S, the balance being Fe and unavoidable impurities, said punched part being part of an electron gun.

10. A punched part according to claim 9, wherein the S content is from 0.0010 to 0.0030%.

11. A punched part according to claim 9, in the form of a sheet, whose thickness is from approximately 0.05 to 0.6 mm.

12. A punched part according to claim 9, having a hardness of from approximately Hv 120 to 160.

13. A punched part according to claim 9, comprising one or more apertures formed by punching.

14. A punched part according to claim 13, wherein said one or more apertures have a diameter approximately the same as or less than the sheet thickness.

15. A punched part according to claim 14, wherein said one or more apertures are defined by a portion of the sheet from which a slug is separated by punching and, further, burrs formed on said portion of the sheet hare a thickness of less than 20 $\mu$m and a height of less than 10 $\mu$m.

* * * * *